US006898152B2

(12) United States Patent
Chan

(10) Patent No.: US 6,898,152 B2
(45) Date of Patent: May 24, 2005

(54) RADIO CONTROLLED CLOCK

(75) Inventor: Raymond Chan, Hunghom (HK)

(73) Assignee: IDT-LCD Holdins (BVI) Limited, Tortola (VG)

( * ) Notice: Subject to any disclaimer, the term of this patent is extended or adjusted under 35 U.S.C. 154(b) by 31 days.

(21) Appl. No.: 10/397,711

(22) Filed: Mar. 27, 2003

(65) Prior Publication Data

US 2003/0189876 A1 Oct. 9, 2003

(30) Foreign Application Priority Data

Apr. 4, 2002 (HK) ..... 02102535

(51) Int. Cl.[7] ..... G04C 11/02
(52) U.S. Cl. ..... 368/47; 368/55
(58) Field of Search ..... 368/46–59

(56) References Cited

U.S. PATENT DOCUMENTS 5,105,396 A 4/1992 Ganter et al.
5,573,109 A * 11/1996 Isacson ..... 206/38.1
5,764,594 A * 6/1998 Berman et al. ..... 368/12
5,930,697 A 7/1999 Böhme et al.
5,995,846 A * 11/1999 Jakobsen ..... 455/517
6,212,469 B1 * 4/2001 Knepper ..... 701/201
6,560,166 B1 * 5/2003 Saito et al. ..... 368/47
6,587,398 B1 * 7/2003 Mock et al. ..... 368/21

FOREIGN PATENT DOCUMENTS

| | | |
|---|---|---|
| DE | 40 12 975 | 10/1991 |
| DE | 195 38 913 | 4/1997 |
| FR | 2 748 332 | 5/1996 |

* cited by examiner

*Primary Examiner*—Kamand Cuneo
*Assistant Examiner*—Thanh S. Phan
(74) *Attorney, Agent, or Firm*—Leydig, Voit & Mayer, Ltd.

(57) ABSTRACT

A radio controlled clock includes a main unit and interchangeable antenna modules. The main unit includes an operating circuit and contacts. The circuit has a CPU and decoders for decoding RF time signals having different carrier frequencies received by the modules. The decoders are connected to the contacts. Each module has a body connectable to main unit body, an operating circuit, and contacts connectable to the contacts of the main unit when a module is connected to the main unit. The circuit of the main body includes a receiver tuned to receive a RF time signal having a specific carrier frequency broadcast in a particular country and sends the signal received, via the contacts to a decoder, enabling the CPU to display the local time on a display.

12 Claims, 3 Drawing Sheets

RADIO CONTROLLED CLOCK

The present invention relates to a radio controlled clock.

BACKGROUND OF THE INVENTION

Radio controlled clocks are known in general, which operate on radio frequency or RF time signals broadcast by local authorities of different countries to provide official local time information that allow individuals to synchronize their timepieces. Existing RF time signals include DCF signal in Germany, MSF signal in United Kingdom, WWVB signal in United States of America and JJY40 and JJY60 signals in Japan. These signals are AM modulated signals at different carrier frequencies and different data protocols.

The existing radio controlled clocks are designed for use in specific countries and therefore cannot be used in different countries.

The subject invention seeks to mitigate or at least alleviate such a shortcoming by providing an improved radio controlled clock.

SUMMARY OF THE INVENTION

According to the invention, there is provided a radio controlled clock comprising a main unit and at least two separate antenna modules selectively connectable to the main unit for co-operation therewith. The main unit comprises a body, an LCD display and a plurality of keys provided on the body, an operating circuitry housed within the body, and a plurality of electrical contacts supported by the body. The operating circuitry comprises a CPU control unit connected to the display for displaying time and to the keys for control, and at least two decoders connected to the CPU control unit for decoding radio frequency time signals of different carrier frequencies received by the antenna modules respectively, said decoders being connected to said contacts. Each antenna module comprises a body releasably connectable to the body of the main unit, an operating circuitry housed within the body, and a plurality of electrical contacts supported by the body for connection to the contacts of the main unit respectively when the antenna module is connected to the main unit. The operating circuitry comprises a receiver tuned to receive a radio frequency time signal of a specific carrier frequency broadcast in a particular country or region and then send the received signal, via the inter-connected contacts, to the respective decoder of the main unit for enabling the CPU control unit to display local time at the display according to the received signal.

Preferably, the receivers of said at least two antenna modules are tuned to receive radio frequency time signals of different carrier frequencies selected from 77.5 kHz, 60 kHz and 40 kHz for subsequent decoding by the respective decoders of the main unit.

More preferably, a third said antenna module is included and the main unit includes a third said decoder for this antenna module, the three receivers being tuned to receive radio frequency time signals of respective carrier frequencies of 77.5 kHz, 60 kHz and 40 kHz for subsequent decoding by the respective decoders.

It is preferred that each antenna module includes a respective antenna connected to the corresponding receiver.

Preferably, the CPU control unit includes a circuit connected to at least one of the main unit contacts for automatically identifying the connected antenna module by detecting a high/low level signal provided at said at least one main unit contact by the receiver of the connected antenna module.

Preferably, the CPU control unit includes a circuit connected to two of the main unit contacts for automatically identifying the connected antenna module by detecting a high/low level signal provided at each of the two main unit contacts by the receiver of the connected antenna module.

It is preferred that the receiver of one of the antenna modules is tuned to receive radio frequency time signals of the same carrier frequency but different data protocols, and the CPU control unit includes a circuit for prompting manual selection of an appropriate protocol on the display in response to the connection of this antenna module to the main unit.

Advantageously, the CPU control unit includes a self-counting clock circuit capable of independent operation in the absence of any one of the antenna modules being connected to the main unit, such that the main unit operates as a stand-alone clock.

Conveniently, the CPU control unit includes a thermal sensor for measuring and indicating the indoor temperature at the display.

In a preferred construction, the body of each of the antenna modules includes a plug projecting therefrom for insertion into the body of the main unit, thereby connecting the antenna body to the main unit body.

More preferably, one of the main unit and antenna bodies includes a spring-loaded catch for engaging a part of the other body through a snap action upon insertion of the plug into the main unit body, thereby locking the two bodies connected together.

More preferably, the main unit and antenna bodies have substantially the same outer cross-section such that when the bodies are connected together, their adjacent peripheral surfaces substantially match and lie flush with each other.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
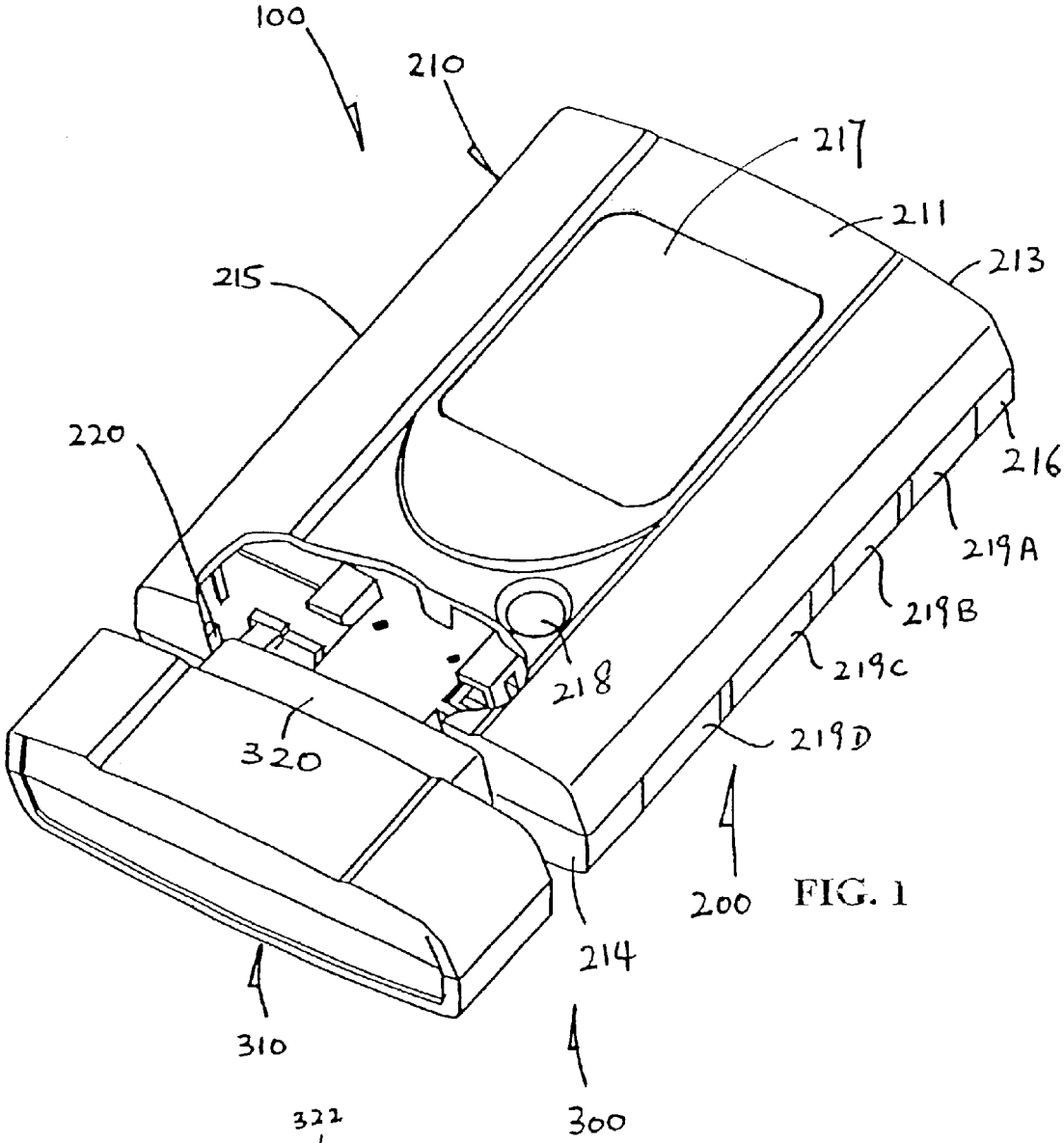
FIG. 1 is a front perspective view of an embodiment of a radio controlled clock in accordance with the invention, said clock comprising a main unit and an antenna module.
Figure 2:
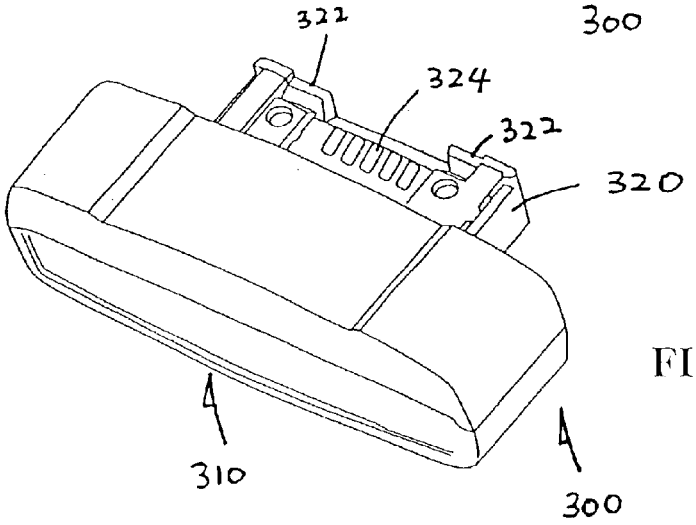
FIG. 2 is a front perspective view of the antenna module of FIG. 1.
Figure 3:
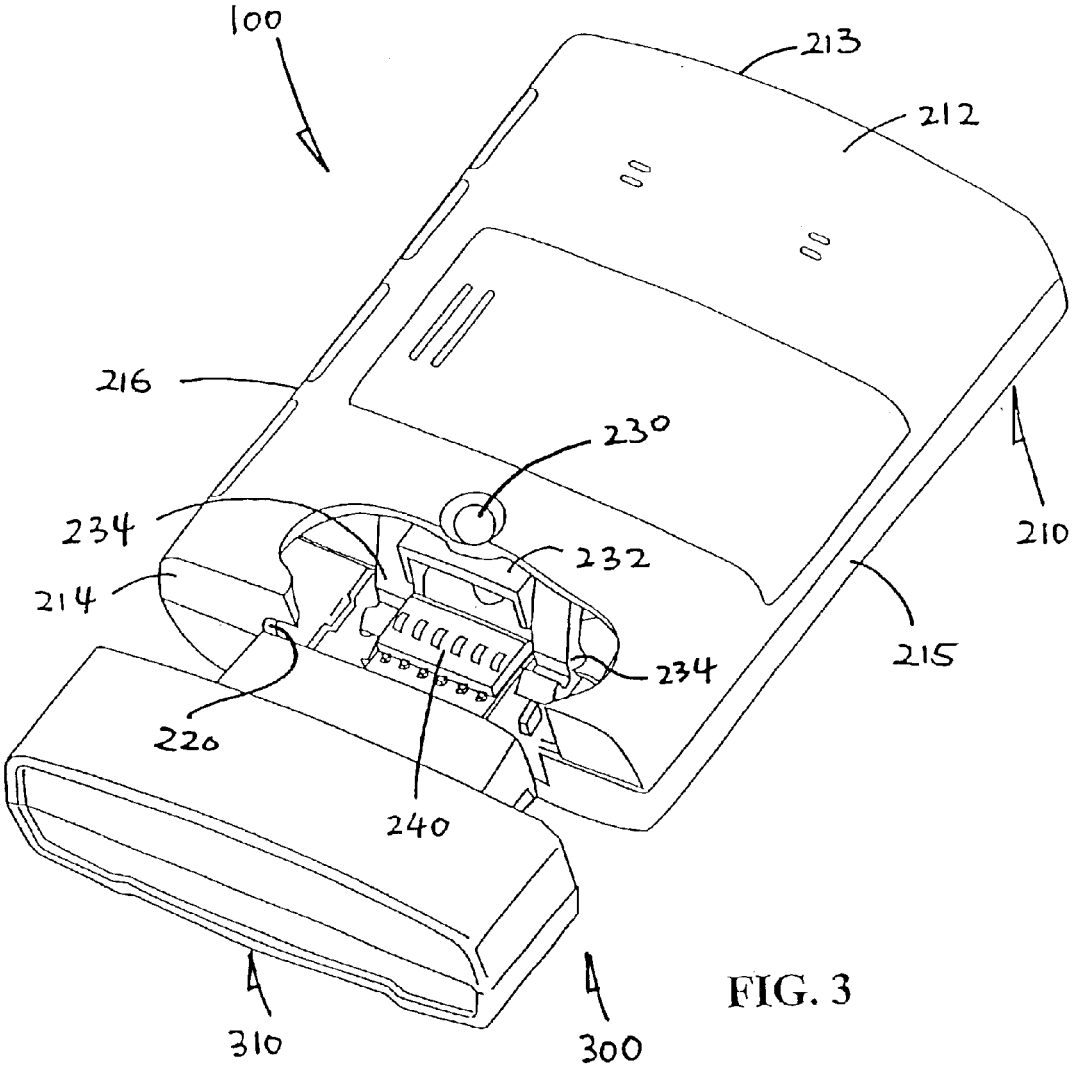
FIG. 3 is a rear perspective view of the main unit and antenna module of FIG. 1.
Figure 4:
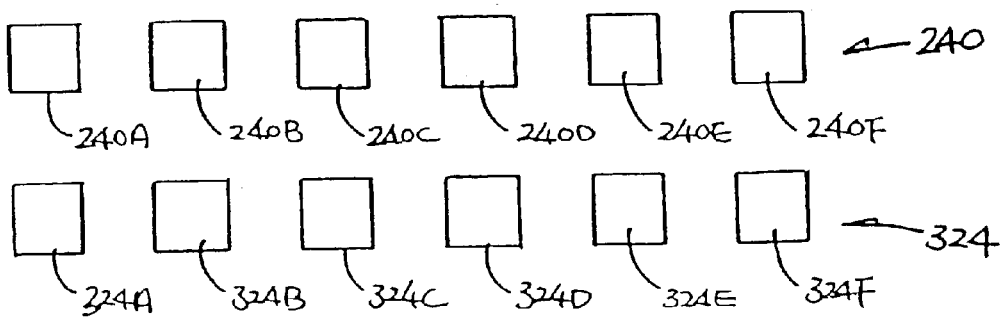
FIG. 4 is a schematic diagram of two sets of contacts between the main unit and the antenna module of FIG. 1.

Referring initially to FIGS. 1 to 4 of the drawings, there is shown a radio controlled clock 100 embodying the invention, which clock 100 comprises a main unit 200 and three separate antenna modules 300A, 300B and 300C, or 300 in general, that are selectively connectable to the main unit 200 for receiving a total number of five different radio frequency or RF control signals broadcast in different countries. The countries in which the antenna modules 300 operate and their respective operating carrier frequencies are summarized in the following table:

| Antenna Modules | Countries | Radio Frequency Signal Code | Carrier Frequencies |
|---|---|---|---|
| 300A | Central Europe, including France, Germany & Italy | DCF | 77.5 kHz |
| 300B | United Kingdom | MSF | 60 kHz |
| 300B | United States of America & Canada | WWVB | 60 kHz |
| 300B | Japan (West side) | JJY60 | 60 kHz |
| 300C | Japan (Central & East side) | JJY40 | 40 kHZ |

The first and third antenna modules 300A and 300C are manufactured to receive DCF and JJY40 RF time signals at 77.5 kHz and 40 kHz carrier frequencies respectively. On the other hand, the second antenna module 300B is made to receive MSF, WWVB and JJY60 RF time signals at a carrier frequency of 60 kHz, whichever code type is selected. Accordingly, by changing the antenna modules 300, the radio controlled clock 100 can switch to different reception frequencies for receiving various RF time signals in up to five different countries or regions.

The main unit 200 has a generally flat rectangular body 210 having front and rear surfaces 211 and 212, on which front surface 211 a LCD display 217 is provided to indicate information relating to, inter alia, time and calendar according to the RF time signals received as well as temperature measured by an internal electronic thermometer. The front surface 211 includes an alarm button 218 for turning on/off an alarm function of the radio clock 100, and the rear surface 212 is provided with a press knob 230 for releasing a connected antenna module 300.

The main unit body 210 has a top end 213 bearing a snooze button (not shown) that can also be used to turn on a back-light for the display 217, and a bottom end 214 formed with a central flat rectangular opening 220. The body 210 has a generally flat cross-section taken in a lateral direction between the top and the bottom ends 213 and 214. The body 210 includes left and right sides 215 and 216, which right side 216 bears a series of four control keys, which are up and down keys 219A and 219B, a mode key 219C and a temperature key 219D. The mode key 219C selects the display modes of the display 217, for example to display the time with seconds, the time with day, or the time of a second time zone. The temperature key 219D displays the current indoor temperature. The up and down keys 219A and 219B are for on-screen selection and/or setting as required.

Each antenna module 300 has a rectangular bar-shaped body 310 that is connectable to the bottom end 214 of the main unit body 210, extending laterally relative to and parking against the main unit body 210. Taken when connected together, the antenna body 310 has the same outer cross-section as the main unit body 210 such that their adjacent peripheral surfaces match and lie flush with each other.

More specifically, the antenna body 310 has an integral plug 320 projecting from its upper side that is insertable into the opening 220 of the main unit body 210, thereby connecting the antenna body 310 to the main unit body 210. The plug 320 includes, internally, a central electrical connector 324 formed by a row of six fixed contacts 324A–F, and a pair of lugs 322 flanking the connector 324. The contacts 324A–F form part of an electronic operating circuitry 350 of the antenna module 300 housed within its body 310.

Referring back to the main unit 200, the press knob 230 forms part of an internal spring-loaded bracket 232 that includes a pair of hooks 234. The hooks 234 are aligned behind the opening 220 for engaging respective lugs 322 of the plug 320 upon insertion through a snap action, thereby locking the antenna body 310 connected to the main unit body 210. Depression of the press knob 230 will release its hooks 234 from the lugs 322 of the antenna body 310, whereupon the antenna module 300 can be unplugged from the main unit 200 for replacement with another module 300.

The main unit 200 includes an internal central electrical connector 240 formed by a row of six spring contacts 240A–F, which are aligned with the fixed contacts 324A–F of the antenna module 300. The fixed contacts 324A–F are arranged to come into electrical connection with the spring contacts 240A–F respectively, upon the antenna module 300 plugging into the main unit 200. The spring contacts 240A–F form part of an electronic operating circuitry 250 of the main unit 200 housed within its body 210.

The spring contacts 240A–F and the corresponding fixed contacts 324A–F are inter-connectable to establish six channels between the main unit 200 and the antenna module 300. The first and second channels are for power supply from the main unit 200 to the antenna module 300. The third and fourth channels are for identification of the three antenna modules 300A to 300C by the main unit 200. The fifth and sixth channels are for signal flow between the main unit 200 to the antenna module 300.

Figure 5:
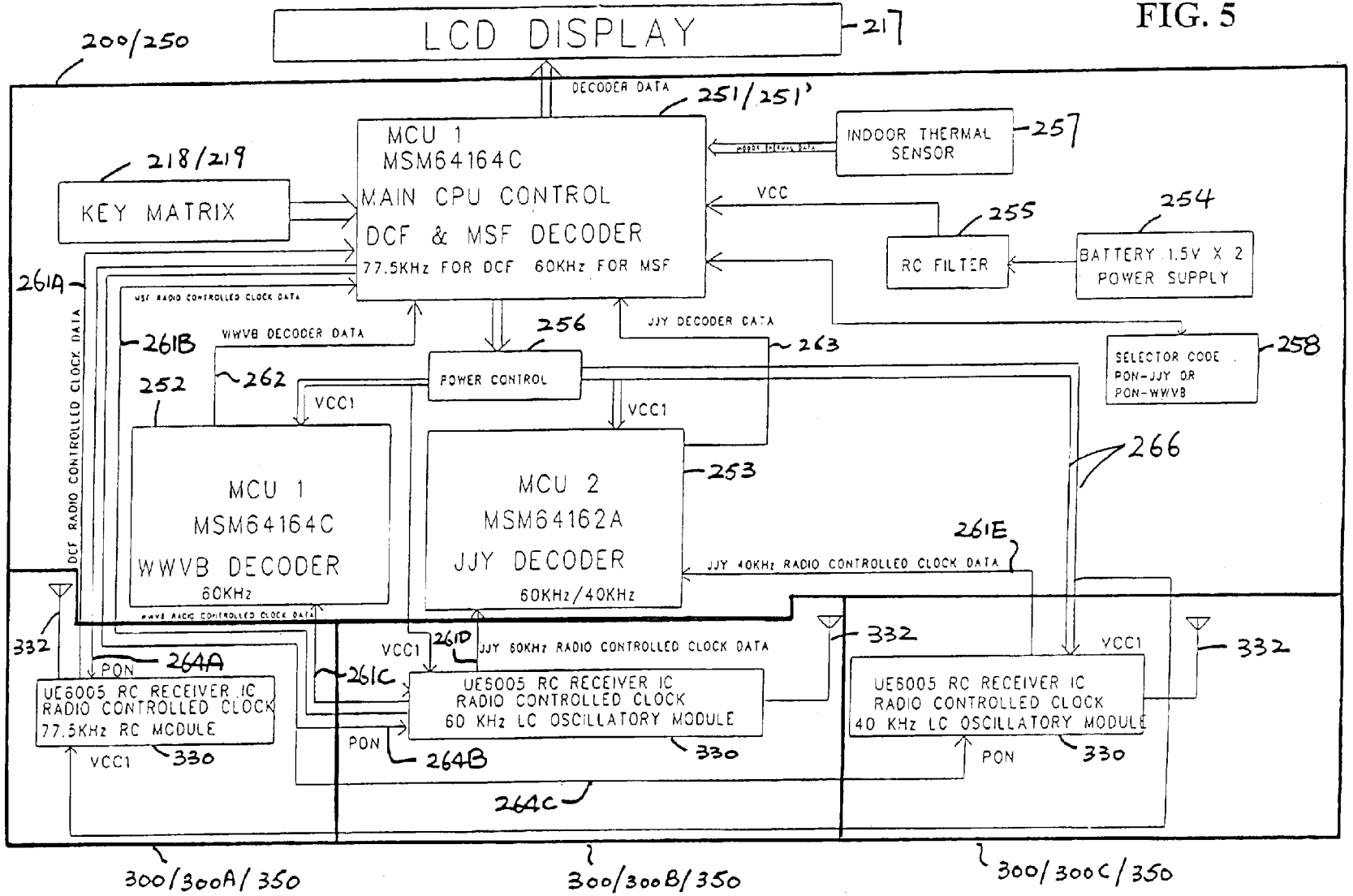
FIG. 5 is a functional block diagram of electronic operating circuitries of the main unit and antenna module of FIG. 1.

Reference is now also made to FIG. 5 of the drawings, which shows the operating circuitries 250 and 350 of the main unit 200 and three antenna modules 300.

The main unit operating circuitry 250 is implemented by three IC chips, i.e. a main CPU control unit 251 including a first DCF/MSF decoder 251' integrated therewith for decoding DCF 77.5 kHz and MSF 60 kHz radio signals, a second WWVB decoder 252 for decoding WWVB 60 kHz radio signal, and a third JJY decoder 253 for decoding JJY 60 kHz and 40 kHz radio signals. The second and third decoders 252 and 253 are connected by respective data lines 262 and 263 to the CPU control unit 251, for sending respective WWVB and JJY data thereto. The LCD display 217 is connected to the CPU control unit 251.

The CPU control unit 251 includes a built-in clock circuit for indicating time at the display 217 according to the data signal decoded by one of the decoders 251' to 253 that is in use. When none of the decoders 251' to 253 is in use, i.e. no antenna module 300 is plugged in the main unit 200, the clock circuit is capable of independent operation by way of self-counting such that the main unit 200 can be used as a stand-alone alarm clock. The CPU control unit 251 further includes a built-in thermometer circuit for measuring and indicating the indoor temperature also at the display 217 according to the signal received from an indoor thermal sensor 257 connected to the CPU control unit 251, which represents the aforesaid thermometer. A key matrix representing the snooze button, alarm button 218 and control keys 219 is also connected to the CPU control unit 251, for controlling the operation of the CPU control unit 251.

A battery power supply 254 located within the main unit body 210 supplies power to the CPU control unit 251 and first DCF/MSF decoder 251' via a RC filter 255. The CPU control unit 251 in turn passes on power to the other two decoders 252 and 253 via a power control unit 256. The power control unit 256 includes a pair of power (VCC1) and ground lines 266 for delivering power to the antenna module 300 in use with the main unit 200, via the first and second main unit contacts 240A and 240B connected with respective first and second antenna contacts 324A and 324B.

Each antenna module 300 incorporates a radio control or RC receiver IC 330 and an antenna 332 connected thereto, which are tuned to receive and demodulate the RF time signal at a specific carrier frequency, or the RF time signal at one of three specific carrier frequencies in the case of the second antenna module 300B, as described above. The receiver IC 330 is connected to the first and second antenna contacts 324A and 324B for obtaining power from the main unit 200 via the power control unit 256.

The main unit operating circuitry 250 includes a set of five data lines 261A–E, which are connected as follows. The first data line 261A connects the first antenna module 300A to the first decoder 251' to enable the transmission of a 77.5 kHz DCF time signal. The second data line 261B connects the second antenna module 300B to the first decoder 251' to enable the transmission of a 60 kHz MSF time signal. The third data line 261C connects the second antenna module 300B to the second decoder 252 to enable the transmission of a 60 kHz WWVB time signal. The fourth data line 261D connects the second antenna module 300B to the third decoder 253 to enable the transmission of a 60 kHz JJY time signal. The fifth data line 261E connects the third antenna module 300C to the third decoder 253 to enable the transmission of a 40 kHz JJY time signal.

All five data lines 261A–E are connected to the fifth main unit contact 240E, and the receiver IC 330 of each antenna module 300 is connected to the associated fifth antenna contact 324E that is in use connected to the main unit contact 240E. Only one of the data lines 261A–E will be enabled at a time, depending on which one of the antenna modules 300A–C is plugged into the main unit 200 as identified by the CPU control unit 251.

The CPU control unit 251 includes a built-in circuit to identify the antenna modules 300A–C by using the third and fourth main unit contacts 240C and 240D as part of or connected to the circuit. The receiver IC 330 of each antenna module 300 is connected to the associated third and fourth antenna contacts 324C and 324D that are in use connected to the third and fourth main unit contacts 240C and 240D respectively. Upon an antenna module 300 being plugged into the main unit 200, its receiver IC 300 provides a preset one of four possible combinations of high and lower levels at the associated antenna contacts 324C and 324D. Each preset combination represents a specific antenna module 300, for example the combination of low and high levels at the antenna contacts 324C and 324D respectively represents the first antenna module 300A, etc. By reading the levels at the main unit contacts 240C and 240D, the CPU control unit 251 is able to identify the antenna modules 300.

The main unit operating circuitry 250 further includes a set of three data or PON lines 264A–C which are connected to the sixth main unit contact 240F. The receiver IC 330 of each antenna module 300 is connected to the associated sixth antenna contact 324F that is in use connected to the sixth main unit contact 240F. The PON lines 264A–C enable the sending of a control signal from the CPU control unit 251 to the corresponding antenna modules 300A–C respectively. Again, only one of the PON lines 264A–C will be enabled at a time, depending on which one of the antenna modules 300A–C is plugged into the main unit 200 as identified by the CPU control unit 251.

Once the first or third antenna module 300A or 300C is identified, the CPU control unit 251 will automatically enable the corresponding data/PON lines 261A/264A or 261E/264C for two-way signal communication. On the other hand if the second antenna module 300B is detected, the CPU control unit 251 will invoke a selector code circuit 258 included therein or connected thereto, as this module 300B is tuned to receive RF time signals of the same carrier frequency of 60 kHz but three different data protocols or types, i.e. MSF, WWVB and JJY60 time signals.

The selector code circuit 258 initially points to the WWVB type on the display 217, or the type as selected previously when the second antenna module 300B was last used, and prompts the user to confirm it using the mode key 219C, or to select another, appropriate type i.e. MSF or JJY60 using the up and down keys 219A and 219B and then confirm it. The CPU control unit 251 will accept the current signal type if the mode key 219C is not pressed within 60 seconds, for example. Upon confirmation of the correct signal type, the CPU control unit 251 will enable the corresponding data/PON lines 261B/264B, 261C/264B or 261D/264B as appropriate for two-way signal communication.

The subject radio controlled clock 100 is versatile and convenient to use, as it can switch to different reception frequencies for receiving various RF time signals in up to five different countries or regions, by simply changing the antenna modules 300.

It is envisaged that in a simplified version, the radio controlled clock of this invention may incorporate only two of the antenna modules 300. In this case, only one of the third and fourth main unit contacts 240C and 240D is sufficient for use to distinguish between the two antenna modules 300 by detecting a high or low level signal at the contact 240C/240D respectively.

The invention has been given by way of example only, and various other modifications and/or variations to the described embodiment may be made by persons skilled in the art without departing from the scope of the invention as specified in the accompanying claims.

What is claimed is:

1. A radio controlled clock comprising:

a main unit; and at least two separate antenna modules selectively connectable to the main unit for co-operation with the main unit, the main unit comprising a main body, a liquid crystal display (LCD) and a plurality of keys on the main body, a main operating circuit housed within the main body, and a plurality of main unit electrical contacts supported by the main body;

the main operating circuit comprising a CPU control unit connected to the LCD for displaying time and to the keys for control, and at least two decoders connected to the CPU control unit for decoding radio frequency time signals having different carrier frequencies and received by respective antenna modules, the decoders being connected to the main unit contacts;

each of the antenna modules comprising a module body releasably connectable to the main body of the main unit, a module operating circuit housed within the module body, and a plurality of module electrical contacts supported by the module body for connection to the contacts of the main unit when the antenna module is connected to the main unit; and the module operating circuitry comprising a receiver tuned to receive a radio frequency time signal of a specific carrier frequency broadcast in a particular country or region and to send the signal received, via the main unit and module contacts, to the respective decoder of the main unit for enabling the CPU control unit to display local time on the LCD according to the signal received.

2. The radio controlled clock as claimed in claim 1, wherein the receivers of the at least two antenna modules are tuned to receive radio frequency time signals having different carrier frequencies selected from 77.5kHz, 60kHz and 40kHz for decoding by respective decoders of the main unit.

3. The radio controlled clock as claimed in claim 2, including a third antenna module and wherein the main unit includes a third decoder for the third antenna module, the three receivers being tuned to receive radio frequency time signals having respective carrier frequencies of 77.5kHz, 60kHz, and 40kHz for decoding by respective decoders.

4. The radio controlled clock as claimed in claim 3, wherein the CPU control unit includes a circuit connected to two of the main unit contacts for automatically identifying the antenna module connected to the main unit by detecting a high/low level signal at each of the two main unit contacts by the receiver of the antenna module connected to the main unit.

5. The radio controlled clock as claimed in claim 1, wherein each antenna module includes a respective antenna connected to the corresponding receiver.

6. The radio controlled clock as claimed in claim 1, wherein the CPU control unit includes a circuit connected to at least one of the main unit contacts for automatically identifying the antenna module connected by detecting a high/low level signal at least one main unit contact by the receiver of the antenna module connected to the main unit.

7. The radio controlled clock as claimed in claim 1, wherein the receiver of one of the antenna modules is tuned to receive radio frequency time signals having the same carrier frequency but different data protocols, and the CPU control unit includes a circuit for prompting manual selection of an appropriate protocol on the LCD in response to the connection of the antenna module to the main unit.

8. The radio controlled clock as claimed in claim 1, wherein the CPU control unit includes a self-counting clock circuit independently operating without an antenna module being connected to the main unit, whereby the main unit operates as a stand-alone clock.

9. The radio controlled clock as claimed in claim 1, wherein the CPU control unit includes a thermal sensor for measuring and indicating temperature at the LCD.

10. The radio controlled clock as claimed in claim 1, wherein the module body of each of the antenna modules includes a projecting plug for insertion into the main body of the main unit, thereby connecting the module body to the main unit main body.

11. The radio controlled clock as claimed in claim 10, wherein one of the main unit and antenna modules includes a spring-loaded catch for engaging a part of the other through a snap action upon insertion of the plug into the main unit main body, thereby locking the main and module bodies together.

12. The radio controlled clock as claimed in claim 10, wherein the main unit and antenna modules have substantially the same outer cross-section so that when the main and modular bodies are connected together, their adjacent peripheral surfaces substantially match and lie flush with each other.

* * * * *